US009001008B2

(12) United States Patent
Nakamura et al.

(10) Patent No.: US 9,001,008 B2
(45) Date of Patent: Apr. 7, 2015

(54) DISPLAY DEVICE

(75) Inventors: Norihiro Nakamura, Mobara (JP); Hajime Akimoto, Kokubunji (JP); Fujio Kawano, Kawasaki (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 12/840,343

(22) Filed: Jul. 21, 2010

(65) Prior Publication Data

US 2011/0018787 A1 Jan. 27, 2011

(30) Foreign Application Priority Data

Jul. 22, 2009 (JP) ..... 2009-170974

(51) Int. Cl.
*G09G 3/30* (2006.01)
*G09G 3/32* (2006.01)

(52) U.S. Cl.
CPC ..... *G09G 3/3291* (2013.01); *G09G 3/3233* (2013.01); *G09G 2300/0861* (2013.01); *G09G 2320/0223* (2013.01); *G09G 2320/0233* (2013.01); *G09G 2330/028* (2013.01); *G09G 2360/16* (2013.01)

(58) Field of Classification Search
CPC ..... G09G 3/30; G09G 3/32
USPC ..... 345/76–79
See application file for complete search history.

(56) References Cited

U.S. PATENT DOCUMENTS

2004/0263444 A1* 12/2004 Kimura ..... 345/82

FOREIGN PATENT DOCUMENTS

JP 2005-003837 1/2005
JP 2008-145648 6/2008

OTHER PUBLICATIONS

Office Action in JP2009-170974, dated Feb. 26, 2013 (in Japanese, 4 pgs.), (partial English language translation).

* cited by examiner

*Primary Examiner* — Tony N Ngo
(74) *Attorney, Agent, or Firm* — Lowe Hauptman & Ham, LLP

(57) ABSTRACT

Provided is a display device including: a display region in which a plurality of pixels each including a light emitting element are arranged; a power supply unit provided outside the display region; a plurality of power supply lines connected to the power supply unit, for supplying power to the elements; and a light emission control unit (108) for determining a reference voltage applied to each of the plurality of pixels to display an image, based on information associated with the image and adjusting currents supplied from the plurality of power supply lines, in which the light emission control unit includes: a correction voltage setting unit (681) for discretely setting predetermined steps of correction voltages based on the information; and a reference voltage determining unit (682) for selecting one of the correction voltages set by the correction voltage setting unit, based on the information, to determine the reference voltage.

4 Claims, 8 Drawing Sheets

DISPLAY DEVICE

CROSS-REFERENCE TO RELATED APPLICATION

The present application claims priority from Japanese application JP 2009-170974 filed on Jul. 22, 2009, the content of which is hereby incorporated by reference into this application.

BACKGROUND OF THE INVENTION

1. Field of the Invention

The present invention relates to a display device including a light emitting element which is an electroluminescence (EL) element, an organic EL element, or another type display element.

2. Description of the Related Art

In a display device in which a plurality of light emitting elements each typified by, for example, an organic EL element are arranged in matrix, power supply voltages for emitting light from the respective light emitting elements are generally collectively supplied from an outside of a display region.

The power supply voltages are supplied from power supply unit provided outside the display region to respective pixels of the display device through power supply lines. When distances between the respective pixels provided in the display region and the power supply unit increase, the power supply voltages supplied to the light emitting elements drop. FIG. 10 is an explanatory view illustrating influence of such voltage drop on an image. In FIG. 10, the power supply unit is mounted on a flexible printed circuit board located on the right side of the display region of FIG. 10. Therefore, a phenomenon in which luminance gradually changes with an increase in distance from the power supply unit (luminance gradient) is recognized by human eyes.

A technology for providing an anode electrode side voltage of a light emitting element with a gradient opposite to the luminance gradient to correct the luminance gradient is disclosed in Japanese Patent Application Laid-open No. 2005-003837.

SUMMARY OF THE INVENTION

In this case, currents supplied from the power supply unit change depending on an image displayed on the display region, and hence voltage drop causing the luminance gradient also changes depending on the displayed image. For example, when a bright image is to be displayed, the currents supplied from the power supply unit are large. Therefore, the voltage drop becomes larger to increase the luminance gradient. When a dark image is to be displayed, the currents supplied from the power supply unit are small. Therefore, the voltage drop becomes smaller to reduce the luminance gradient. Thus, when the voltage drop is corrected based on only a distance or resistance from the power supply unit, there may arise a case where the luminance gradient cannot be corrected depending on a displayed image or there may arise a case where opposite luminance gradient occurs depending on the displayed image.

When the luminance gradient is corrected, for example, there may arise a case where boundaries of different luminances (correction steps) as illustrated in FIG. 11 are visually recognized. The generation of such correction steps may be suppressed by improving digital to analog converter (DAC) resolution. However, when the DAC resolution is improved, a size of an IC chip increases, which is not desirable.

An object of the present invention is to provide a display device capable of improving correction precision of the above-mentioned luminance gradient caused by the drop of voltages from the power supply unit.

In order to solve the above-mentioned problem, a display device according to a first aspect of the present invention includes: a display region in which a plurality of pixels each including a light emitting element are arranged; power supply unit provided outside the display region; a plurality of power supply lines connected to the power supply unit, for supplying power to the light emitting elements; and light emission control unit for determining a reference voltage applied to each of the plurality of pixels to display an image on the display region, based on information associated with the image, adjusting currents supplied from the power supply lines to the light emitting elements and controlling light emission luminances based on the currents, in which the light emission control unit includes: correction voltage setting unit for discretely setting predetermined steps of correction voltages based on the information associated with the image; and reference voltage determining unit for selecting one of the correction voltages set by the correction voltage setting unit, based on the information associated with the image, to determine the reference voltage.

Further, in the display device according to the first aspect of the present invention, the correction voltage setting unit may determine a range in which the correction voltages are discretely set, based on the information.

Further, in the display device according to the first aspect of the present invention, the light emission control unit may cause the correction voltage setting unit to set the correction voltages and may cause the reference voltage determining unit to determine the reference voltage, based on a variation in luminance which is generated in the image, depending on a positional relationship with the power supply unit.

Further, in the display device according to the first aspect of the present invention, the reference voltage determining unit may shift the reference voltage applied to one of the plurality of pixels based on a luminance of the one of the plurality of pixels and a distance associated with the one of the plurality of pixels and the power supply unit.

Further, in the display device according to the first aspect of the present invention, the reference voltage may have a rectangular waveform.

In view of the above-mentioned problem, a display device according to a second aspect of the present invention includes: a display region in which a plurality of pixels each including a light emitting element are arranged; power supply unit provided outside the display region; a plurality of power supply lines connected to the power supply unit, for supplying power to the light emitting elements; and light emission control unit for determining a reference voltage applied to each of the plurality of pixels to display an image on the display region, based on information associated with the image, adjusting currents supplied from the power supply lines to the light emitting elements and controlling light emission luminances based on the currents, in which the light emission control unit determines the reference voltage based on a variation in luminance which is generated depending on a positional relationship with the power supply unit, for each light emission color of the light emitting elements.

In view of the above-mentioned problem, a display device according to a third aspect of the present invention includes: a display region in which a plurality of pixels each including a light emitting element are arranged; power supply unit provided outside the display region; a plurality of power supply lines connected to the power supply unit, for supplying power to the light emitting elements; a plurality of signal lines arranged at increasing distances from the power supply unit, for supplying reference voltages that control light emission luminances of the light emitting elements by supplying currents from the plurality of power supply lines to the light emitting elements; and light emission control unit for controlling the reference voltages applied from the respective signal lines to display an image on the display region, based on information associated with the image, in which the light emission control unit includes: correction voltage setting unit for discretely setting predetermined steps of correction voltages based on the information associated with the image; and reference voltage determining unit for selecting one of the correction voltages set by the correction voltage setting unit, based on the information associated with the image, to determine the reference voltages supplied to the respective signal lines.

Further, in the display device according to the third aspect of the present invention, the plurality of power supply lines may be arranged at an increasing distances from the power supply unit, and connected to wirings which have a predetermined resistance value and extend from the power supply unit, to be connected to the power supply unit.

Further, in the display device according to the third aspect of the present invention, the reference voltage determining unit may shift one of the reference voltages applied to one of the plurality of pixels connected to the respective signal lines based on a luminance of the one of the plurality of pixels and a distance associated with the one of the plurality of pixels and the power supply unit.

Further, in the display device according to the third aspect of the present invention, the light emission control unit may include the correction voltage setting unit and the reference voltage determining unit for each light emission color of the light emitting elements, and the reference voltage determining unit may shift one of the reference voltages which is applied to one of the plurality of signal lines based on a luminance of one of the plurality of pixels which is connected to the one of the plurality of signal lines and a distance associated with the one of the signal lines and the power supply unit, for each light emission color of the light emitting elements.

Further, in the display device according to the third aspect of the present invention, the reference voltage determining unit may select one of the correction voltages for each at least two of the signal lines to determine one of the reference voltages.

According to the present invention, a display device capable of improving correction precision of the luminance gradient caused by the drop of voltages from the power supply unit may be provided.

DETAILED DESCRIPTION OF THE INVENTION

Hereinafter, respective embodiments according to the present invention are described with reference to the accompanying drawings. In the following descriptions, the same constituent elements are expressed by the same reference symbols, and thus the duplicated descriptions of the same constituent elements are omitted.

First Embodiment

Figure 1:
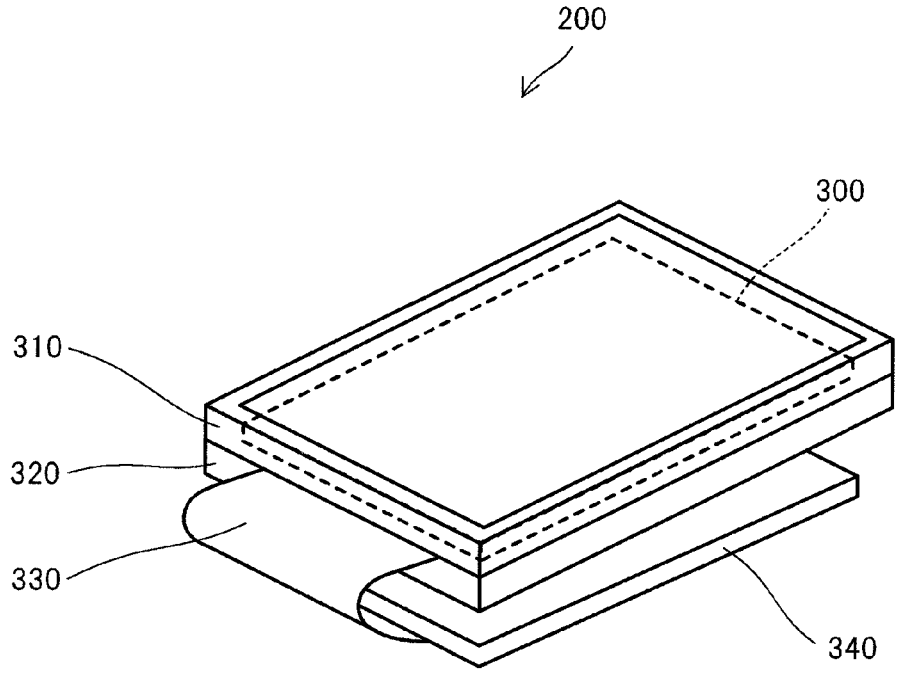
FIG. 1 illustrates an organic EL display device (display device) according to a first embodiment of the present invention.

FIG. 1 illustrates a display device according to a first embodiment of the present invention. In this embodiment, the display device is an organic EL display device 200. As illustrated in FIG. 1, the organic EL display device 200 includes a thin film transistor (TFT) substrate 300, an upper frame 310, a lower frame 320, a circuit substrate 340, and a flexible substrate 330. The upper frame 310 and the lower frame 320 are provided to sandwich and fix an organic EL panel including the TFT substrate 300 and a sealing substrate (not shown). The circuit substrate 340 includes circuit elements for generating display information. The flexible substrate 330 is used to transmit RGB information generated by the circuit substrate 340 to the TFT substrate 300. The circuit substrate 340 includes a power supply circuit. Power supply voltages for displaying an image on the organic EL panel are supplied through the flexible substrate 330.

Figure 2:
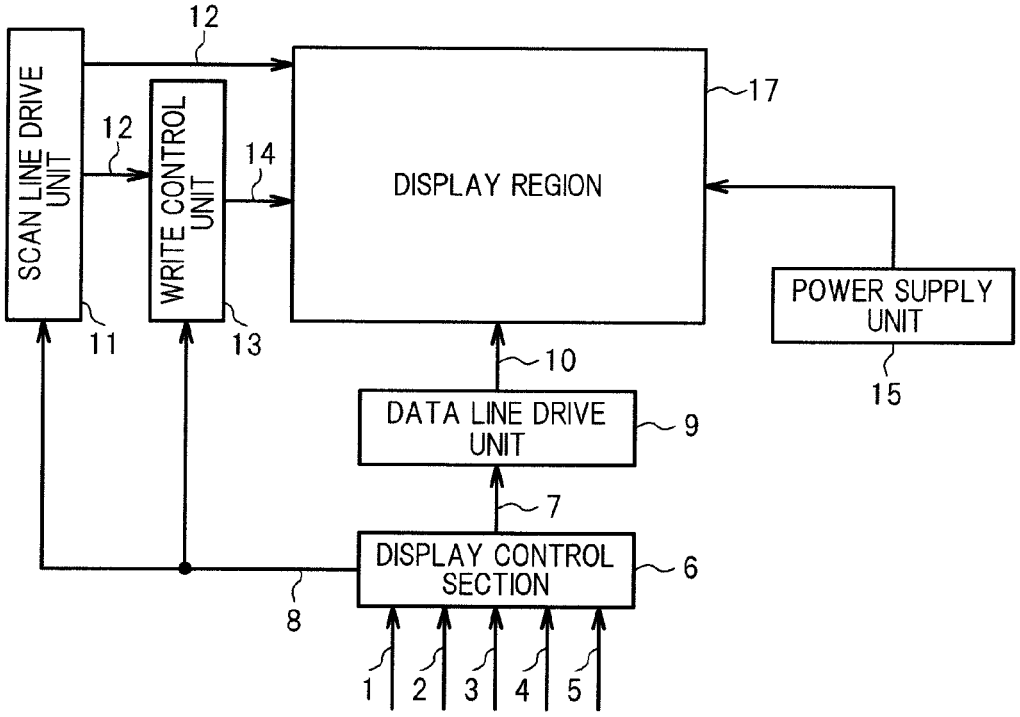
FIG. 2 is an explanatory diagram illustrating a schematic structure of the organic EL display device according to the first embodiment of the present invention.

FIG. 2 is an explanatory diagram illustrating a schematic structure of the organic EL display device 200 according to the first embodiment of the present invention. The circuit substrate 340 includes a display control section 6, data line drive unit 9, scan line drive unit 11, write control unit 13, and power supply unit 15. Signals or power supply voltages are supplied from the circuit substrate 340 to the TFT substrate 300 to display an image on a display region 17 of the organic EL panel.

A horizontal synchronizing signal 1, a vertical synchronizing signal 2, a data enable signal 3, display data 4, and a synchronizing clock 5 are supplied to the display control section 6. Then, the display control section 6 generates a data line control signal 7 and a scan line control signal 8 based on the signals, the data, and the clock. The vertical synchronizing signal 2 is a one-display (one-frame) period signal. The horizontal synchronizing signal 1 is a one-horizontal period signal. The data enable signal 3 is a signal indicating a period during which the display data 4 is enabled (display enable period). The signals are input in synchronization with the synchronizing clock 5. In this embodiment, the following description is based on the assumption that the display data 4 corresponding to a frame is supplied to the display control section 6 in a raster scan fashion in an order from an upper-left end pixel and information corresponding to a pixel in the display region 17 includes 8-bit digital data.

The scan line control signal 8 is supplied to the scan line drive unit (circuit) 11. Then, the scan line drive unit 11 sequentially supplies scan signals to the display region 17. The scan line control signal 8 is supplied to the write control unit (circuit) 13. Then, at a timing when each pixel row is selected by the scan line drive unit 11, a data write control signal 14 for storing charges in capacitor elements provided in respective pixels on the corresponding pixel row is supplied to the display region 17. Meanwhile, the data line drive unit (circuit) 9 applies display signals (signal voltages) to the respective pixels of the selected pixel row when each pixel row is selected by the scan line drive unit 11. Upon receiving the data line control signal 7, the data line drive unit 9 outputs data line drive signals 10. The data line drive signals 10 include display signals (signal voltages) for writing charges based on gradation values of display luminance and a light emission control signal (reference voltage) supplied during the display of an image (retrace period) after the signal voltages are written into the respective pixels. The data line drive unit 9 is described in detail later.

The display region 17 includes a plurality of pixels each having an organic EL element, which are arranged in matrix. The power supply unit 15 generates a power supply voltage for supplying a current to emit light from the organic EL elements. In this embodiment, the current from the power supply unit 15 is supplied to the respective pixels of the display region 17 through a light emitting element drive wiring 16 and power supply lines. The light emitting element drive wiring 16 is, for example, a relatively-high resistance wiring which extends from the lower-right end of the organic EL panel, passes through the lower side of the organic EL panel in the lateral direction, and reaches the lower-left end thereof. On the other hand, the power supply lines each are a relatively-low resistance wiring. The voltage drop of the light emitting element drive wiring 16 is larger than the voltage drop of the power supply line. In this embodiment, the following description is based on the assumption that the display region 17 has a luminance gradient occurring in the lateral direction because of the voltage drop of the light emitting element drive wiring 16 provided along the circumference of the display region 17, and thus becomes darker from right to left.

In the display region 17, data are written into pixels which are selected and write-controlled based on scan line drive signals 12 output from the scan line drive unit 11, in response to signal voltages based on the data line drive signals 10 output from the data line drive unit 9. Then, the light emission control signals are supplied to display an image. The voltage for driving the organic EL elements in the respective pixels of the display region 17 is supplied from the power supply unit 15 through the light emitting element drive wiring 16 and the power supply lines. In this embodiment, the display control section 6, the data line drive unit 9, the scan line drive unit 11, and the write control unit 13 are included in the circuit substrate 340, but may be realized using separate large-scale integrated (LSI) circuits or a single LSI circuit, and may be formed on the same glass substrate as the display region 17.

Figure 3:
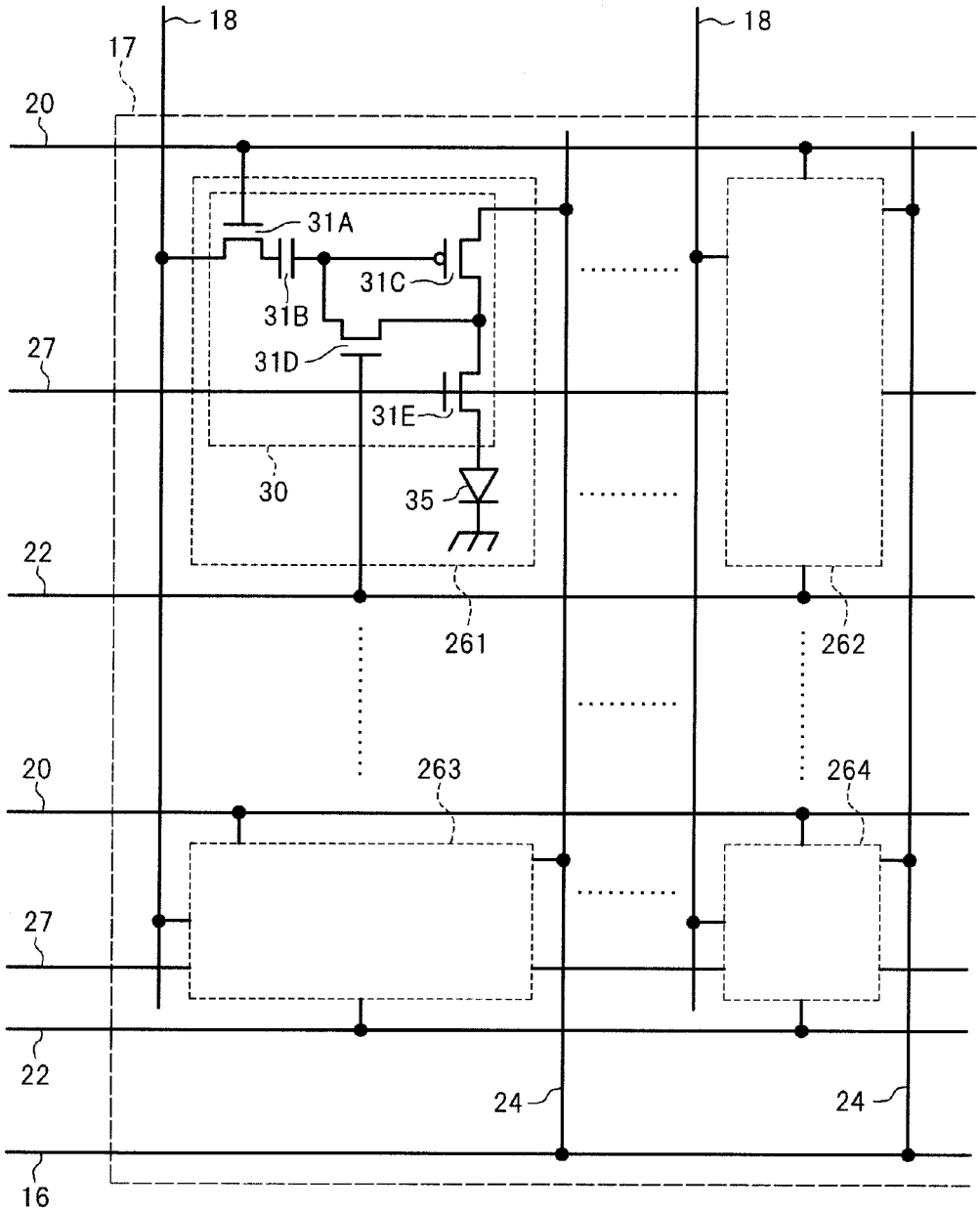
FIG. 3 is a schematic circuit diagram illustrating a display region of an organic EL panel in the first embodiment of the present invention.

FIG. 3 is a schematic circuit diagram illustrating the display region 17 of the organic EL panel in the first embodiment of the present invention. FIG. 3 illustrates a pixel 261 located in a first row and a first column, other pixels 262, 263, 264, and the like, which are arranged in matrix. Hereinafter, a structure of the pixel 261 located in the first row and the first column is described in detail, but the other pixels have the same structure. In the display region 17, a plurality of scan lines 20, a plurality of write control lines 22, and a plurality of turn-on switch lines 27 are provided in the lateral direction of FIG. 3, and a plurality of data lines 18 and a plurality of power supply lines 24 are provided in the longitudinal direction of FIG. 3, to thereby form the respective pixels into squares. In particular, the pixel 261 includes an organic EL element 35, a scan switch 31A, a capacitor element 31B, a drive switch 31C, a write control switch 31D, and a turn-on switch 31E. A region surrounded by a broken line of FIG. 3 in the pixel 261 corresponds to a pixel drive section 30 for driving the organic EL element 35 to emit light based on charges corresponding to a gradation value, which are stored in the capacitor element 31B. The scan switch 31A is turned on in response to the scan line drive signal 12 supplied to the scan line 20. The write control switch 31D is turned on in response to the data write control signal 14 supplied through the write control line 22. The turn-on switch 31E is turned on in response to a signal supplied to the first-row turn-on switch line 27.

The light emission of the organic EL element 35 using the respective switches of the pixel drive section 30 and respective signal lines connected to the pixel drive section 30 is described. First, the scan switch 31A, the write control switch 31D, and the turn-on switch 31E are turned on to supply a low potential from the data line 18 to a gate terminal of the PMOS drive switch 31C, and hence charges of a preceding frame which are written in the capacitor element 31B are released for resetting to the organic EL element 35 (pre-charge operation).

Next, the scan switch 31A and the write control switch 31D are turned on to supply a potential (Vdata) corresponding to a gradation value from the data line 18 to the gate terminal of the PMOS drive switch 31C, to thereby supply charges from the power supply line 24 to the capacitor element 31B (write operation). With respect to the capacitor element 31B, in this embodiment, when the organic EL element 35 emits light at a luminance corresponding to a gradation value of zero (black display), the potential Vdata is 0V. When the organic EL element 35 emits light at a luminance corresponding to a gradation value of 255 (white display), the potential Vdata is 3 V. When 10 V is supplied as a predetermined potential (Vdd) from the power supply line 24, the potential passes through the drive switch 31C, and hence a potential of 8 V is supplied to the capacitor element 31B. In this manner, the voltage drop of the predetermined potential occurs as described above (voltage drop of the light emitting element drive wiring 16). Therefore, a potential supplied to each of the power supply lines 24 is changed.

Next, when another row is subjected to the write operation, the scan switch 31A and the write control switch 31D are turned off to maintain the charges of the capacitor element 31B (operation during non-writing). After that, when the scan switch 31A and the turn-on switch 31E are turned on to apply a reference voltage (Vsweep) to the data line 18, the drive switch 31C is turned on, and hence a current flows from the power supply line 24 into the organic EL element 35 to emit light (light emission operation). At this time, the organic EL element 35 emits light at a luminance corresponding to a gradation value based on the charges stored in the capacitor element 31B. While the potential Vdata is 0 V, a voltage of 8 V is applied to the capacitor element 31B. In this case, the drive switch 31C prevents the current from flowing into the organic EL element 35. That is, a threshold voltage (Vth) of the drive switch 31C is 8 V. While the potential Vdata is 3 V, a voltage of 5 V is applied to the capacitor element 31B. Then, the current is supplied to the organic EL element 35 through the drive switch 31C in order to perform white display with a luminance of 255. Therefore, the voltage in the range of 5 V to 8 V is applied to the capacitor element 31B to represent a gradation value in a range of 0 to 255.

A frame period in which the image is displayed on the display region 17 includes a write period in which the scan lines 20 extending in the lateral direction of FIG. 3 are selected in order from a side to write charges corresponding to gradation values into the capacitor elements 31B of the respective pixels, and a light emission period in which light are emitted from the organic EL elements 35 after the writing into all the pixels of the display region 17 is completed. In this embodiment, as described above, during the light emission period, the reference voltage is supplied from the respective data lines 18 to turn on the drive switches 31C of all the pixels of the display region 17, and hence the organic EL element 35 of each of the pixels emits light at a luminance corresponding to a gradation value. The luminance of the organic EL element 35 is substantially proportional to a supplied current, and hence the luminance of the organic EL element 35 is set based on the changes of the capacitor element 31B and a level of the reference voltage. In this embodiment, the reference voltage is supplied from the data lines 18. However, the reference voltage may be supplied from signal lines for supplying other signals to the pixels.

Figure 4:
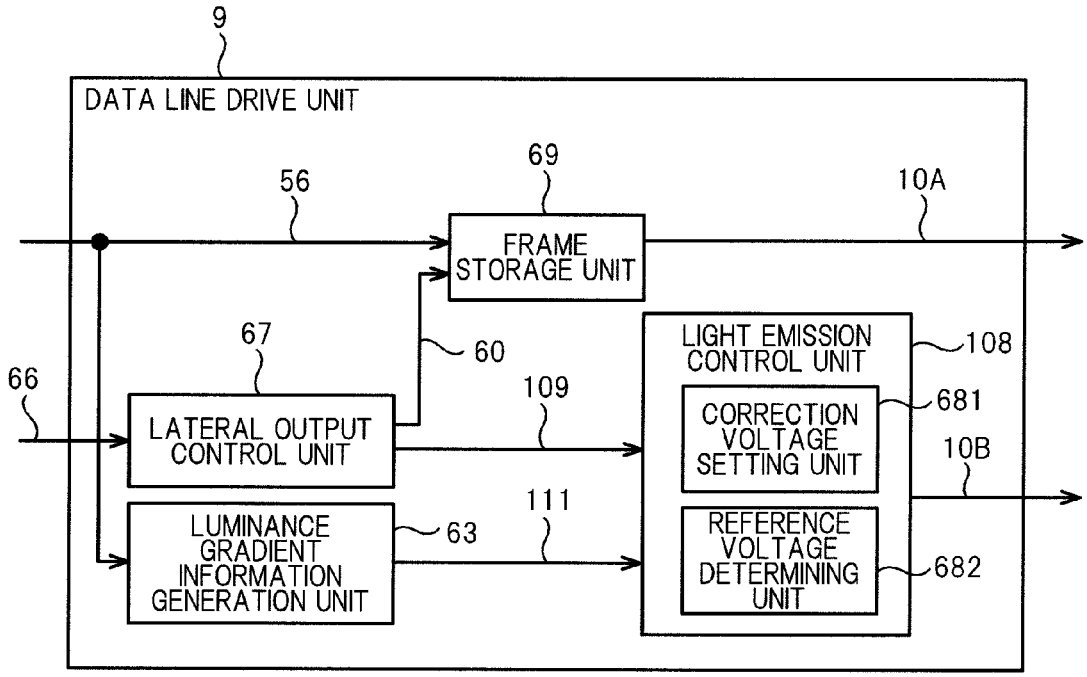
FIG. 4 is a block diagram illustrating a functional structure of data line drive unit in the first embodiment of the present invention.

FIG. 4 is a block diagram illustrating a functional structure of the data line drive unit 9 in this embodiment. As illustrated in FIG. 4, display input serial data 56 and a lateral output timing 66 are input to the data line drive unit 9, and a display signal 10A and a light emission control signal 10B are output therefrom. The display signal 10A and the light emission control signal 10B are output as the data line drive signals 10 for driving the respective data lines 18 of the display region 17. A data start signal 54 and a data clock 55 which are not illustrated in FIG. 4 are input together with the display input serial data 56, and hence the display input serial data 56, the data start signal 54, the data clock 55, and the lateral output timing 66 serve as the data line control signal 7.

The display input serial data 56 is data including a series of gradation values of respective pixels for each line (row), of an image displayed during a frame period, and temporarily stored in frame storage unit 69. The frame storage unit 69 receives a lateral data read pulse 60 from lateral output control unit 67 to which the lateral output timing 66 is input, and outputs, as the display signal 10A, data for each line, of the display input serial data 56 at a received timing.

Luminance gradient information generation unit 63 to which the display input serial data 56 is supplied, separately from the frame storage unit 69, is described. The luminance gradient information generation unit 63 includes image data acquisition unit (not shown) for acquiring the display input serial data 56 together with the data start signal 54 and the data clock 55 which are not illustrated in FIG. 4 to obtain luminance information of respective pixels of a one-frame image. The luminance gradient information generation unit 63 latches, as a part of the acquired image data, one-line luminance data in a central pixel row (one-line luminance information). The voltage drop caused in the light emitting element drive wiring 16 varies depending on the current from the power supply unit 15. The currents supplied from the power supply lines 24 substantially correspond to respective luminance values of one-line luminance information. Therefore, in order to derive the amount of voltage drop which is caused in the light emitting element drive wiring 16 between the power supply unit 15 and the respective power supply lines 24, the luminance gradient information generation unit 63 generates one-line data (voltage drop information) obtained as a total of luminance of the pixel corresponding to the power supply line 24 closest to the power supply unit 15 and luminances of the pixels corresponding to the other power supply lines 24 in the above-mentioned one-line luminance information. The luminance gradient information generation unit 63 converts the amount of voltage drop into a luminance to generate data of a luminance gradient caused during the display of a one-frame image (luminance gradient information 111) based on the voltage drop information, and outputs the luminance gradient information 111 to light emission control unit 108 described later. In this embodiment, the luminance gradient information 111 is one-line data exhibiting the amount of luminance gradation change caused by the voltage drop. To be specific, the amount of luminance gradation change is obtained from "(luminance value)×((voltage after voltage drop)/(voltage in case where voltage drop does not occur))". Therefore, the luminance gradient information 111 is obtained based on the one-line luminance information and the one-line voltage drop information.

The light emission control unit 108 receives, from the luminance gradient information generation unit 63, the luminance gradient information 111 generated based on the displayed image. Then, during the light emission period of a one-frame period, the light emission control unit 108 supplies, to the pixels connected to each of the data lines 18, the light emission control signal 10B (reference voltage) based on a positional relationship with the power supply unit 15. A gradation value of luminance of the organic EL element 35 is reduced by the voltage drop of the light emitting element drive wiring 16. In order to reduce the luminance gradient of the displayed image, the light emission control unit 108 adjusts the reference voltage applied to the gate terminal of the drive switch 31C through the data line 18 based on the luminance gradient information 111 to control the light emission of each of the pixels. The light emission control unit 108 shifts the reference voltage applied to the gate terminal of the drive switch 31C based on the current flowing through the power supply line 24 (luminance of pixel connected to data line 18) and a distance from the power supply unit 15, to facilitate the supply of the current from the power supply line 24 to the organic EL element 35, to thereby improve the gradation value of each of the pixels which is reduced by the voltage drop. In this embodiment, the voltage applied to the gate terminal is 8 V during black display with a luminance value of 0 and 5 V during white display with a luminance value of 255. Therefore, the reference voltage (set as 0 V in normal case) is further shifted to a low value to apply a voltage to the gate terminal of the drive switch 31C in a range lower than a range of 5 V to 8V, and thereby the gradation value may be increased. In this embodiment, the data lines 18 are arranged to gradually increase a distance from a flexible printed circuit board on which the power supply unit 15 is mounted. When the data line 18 is located at a further distance from the power supply unit 15, the current supplied to each of the organic EL elements 35 connected to the corresponding data line 18 is more affected by the voltage drop. Therefore, for example, when an image having a constant luminance distribution is to be displayed, it is necessary to shift the reference voltage to a low value with an increase in distance from the power supply unit 15, to facilitate the supply of current.

Figure 5:
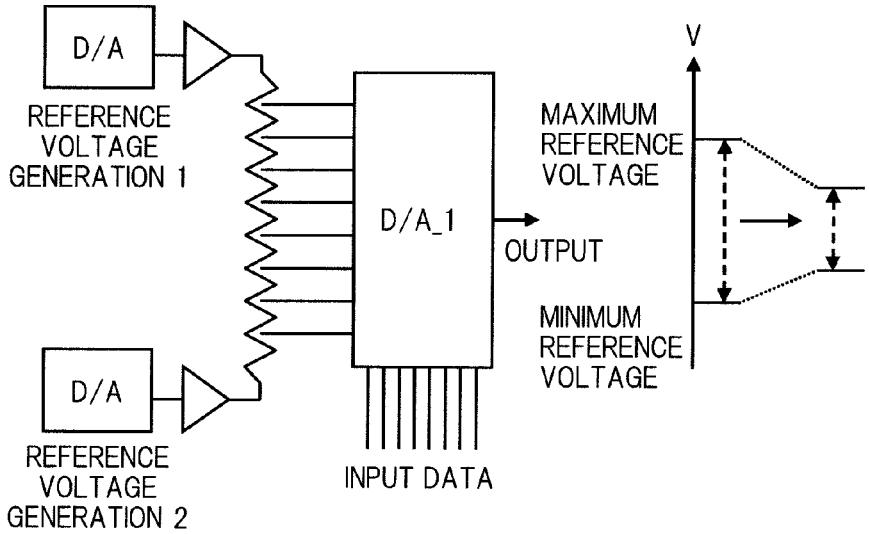
FIG. 5 is a concept diagram illustrating correction voltage setting unit in the first embodiment of the present invention.

Correction voltage setting unit 681 determines a correction voltage having predetermined gradation levels, which is selected as the reference voltage for the respective data lines 18, based on the luminance gradient information 111 received from the luminance gradient information generation unit 63. FIG. 5 is a concept diagram illustrating the correction voltage setting unit 681 in this embodiment. In this embodiment, the correction voltage has 255 gradation levels (steps). The luminance gradient information 111 exhibits a deviation from a target luminance value. When the luminance value of the one-line luminance information is a constant value, the luminance reduces as the distance between the power supply unit 15 and the data line 18 increases. For example, the correction voltage setting unit 681 determines a correction voltage range (range of maximum reference voltage to minimum reference voltage) based on maximum and minimum values of the deviation from the target luminance value. When a bright image is to be displayed, the correction voltage range is wide. When a dark image is to be displayed, the correction voltage range is narrow. Even when the correction voltage range is narrow, predetermined steps of resolution are maintained, and hence correction steps are inconspicuous. Moreover, for example, when an image of which a central area is bright and a peripheral area is dark is to be displayed, the range based on the maximum reference voltage and the minimum reference voltage may be adjusted as illustrated in FIG. 5. Even in this case, the predetermined steps of resolution are maintained within the set range, and hence the correction steps are inconspicuous.

Further, for example, when an image of which an area far away from the power supply unit 15 is bright and an area close thereto is dark is to be displayed, a change in luminance of the dark area which is caused by voltage drop is inconspicuous. Therefore, when the correction voltage is set mainly for the bright area of which a change in luminance is large, the correction steps are inconspicuous. To be specific, the gradation levels of the correction voltage are set based on the amount of change of the deviation from the target luminance value. The number of gradation levels of the correction voltage which are allocated to the bright area of the image is larger than the number of gradation levels of the correction voltage which are allocated to the dark area of the image.

The correction voltage range is determined based on the luminance gradient information 111, and predetermined steps are set within the determined correction voltage range. Reference voltage determining unit 682 selects one of the predetermined steps (gradation levels) of the correction voltage which is set by the correction voltage setting unit 681, based on the luminance gradient information 111, and determines the selected level as the reference voltage applied to the respective data lines 18. Therefore, the reference voltage is subjected to digital/analog conversion. The reference voltage is determined by selecting a level of the correction voltage which corresponds to the deviation from the target luminance value for each of the data lines 18. Alternatively, the reference voltage may be determined by selecting the correction voltage for each a plurality of (for example, two) data lines 18.

The lateral output control unit 67 receives the lateral output timing 66, supplies the lateral data read pulse 60 to the frame storage unit 69, and supplies a light emission control start signal 109 to the light emission control unit 108. The frame storage unit 69 temporarily stores the display input serial data 56, collectively reads lateral line data in response to the lateral data read pulse 60, and sequentially outputs each line data during the data write period. In response to the light emission control start signal 109 derived from the lateral output timing 66, the data write period is completed, the light emission control period starts, and the light emission control unit 108 outputs a reference voltage having a rectangular wave to the respective data lines 18.

Figure 6:
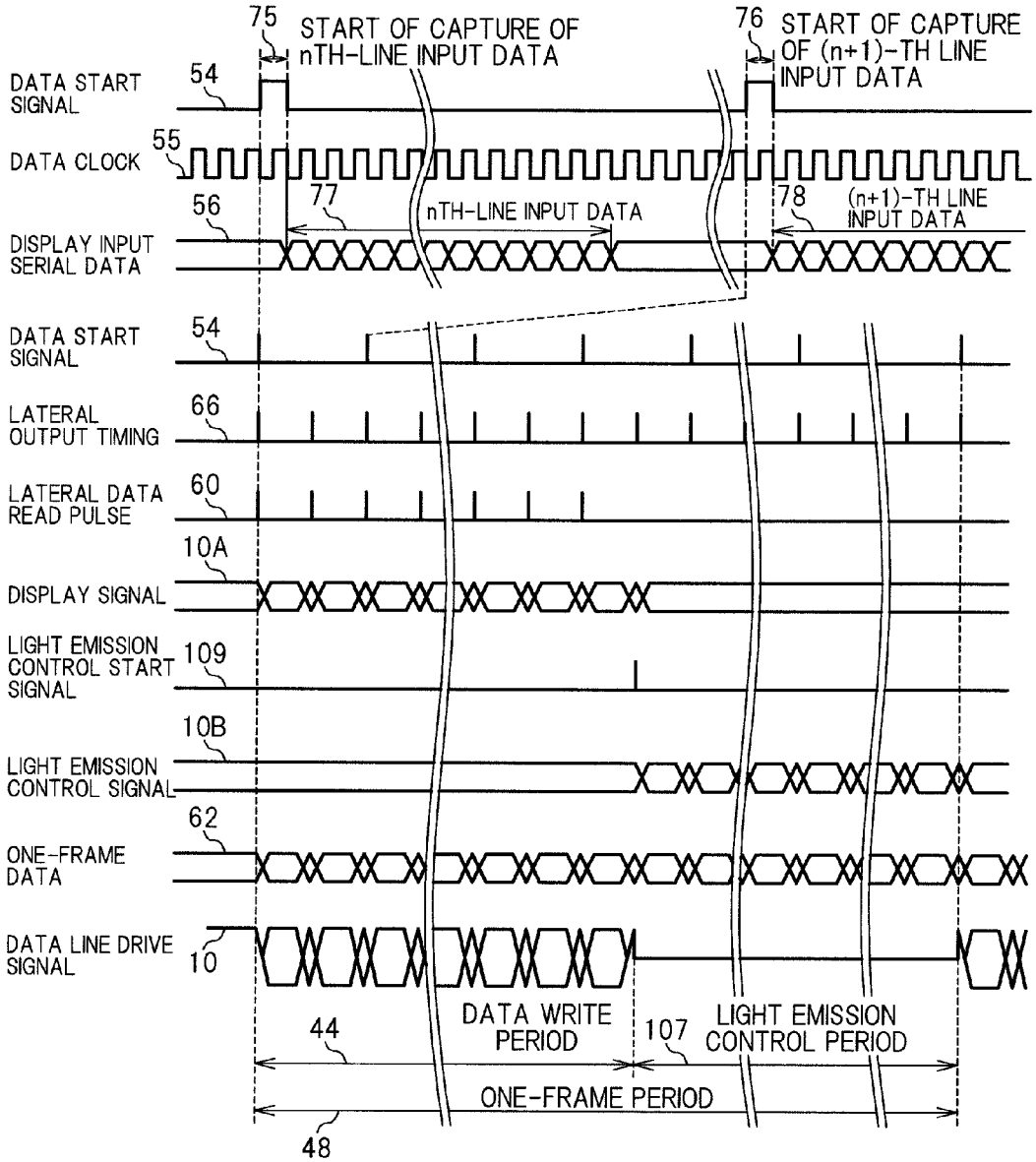
FIG. 6 is a timing chart illustrating an operation of the data line drive unit in the first embodiment of the present invention.

FIG. 6 is a timing chart illustrating an operation of the data line drive unit 9 in this embodiment. The display input serial data 56 is captured at the data clock 55 relative to a timing in which the data start signal 54 becomes "1", and temporarily stored in the frame storage unit 69. For example, nth-line display input serial data 77 (nth-line input data) is captured in response to the data clock 55 next to an nth-line input data capture start timing 75 and temporarily stored in the frame storage unit 69. In a lower side of FIG. 6, a time axis of the data start signal 54 is extended and there is a timing chart illustrating other signals. One-lateral line data of the temporarily stored display input serial data 56 are collectively read at a timing of the lateral data read pulse 60 during the data write period 44. In this embodiment, the data write period 44 is shortened and the light emission control period 107 is lengthened. Therefore, the following description is based on the assumption that the frequency of the lateral data read pulse 60 which is a read timing is set to a value (two times in this case) higher than the frequency of the data start signal 54 and one-frame display data is temporarily stored in the light emission control period 107.

The light emission control start signal 109 starts at a timing in which the output of display input data of a final line is completed after a final pulse of the lateral data read pulse 60. The light emission control signal 10B is output as a rectangular wave signal during the light emission control period 107 which is a period obtained by subtracting the data write period 44 from a one-frame period 48. Therefore, one-frame data 62 output during the data write period 44 is the display signal 10A and one-frame data 62 output during the light emission control period 107 (rectangular wave period) is the light emission control signal 10B. Finally, the data line drive signals 10 become signals obtained by performing analog conversion on the one-frame data 62. During the light emission control period 107, a rectangular-wave reference voltage having a predetermined level is supplied as the light emission control signal 10B to each of the data lines 18.

Figure 7:
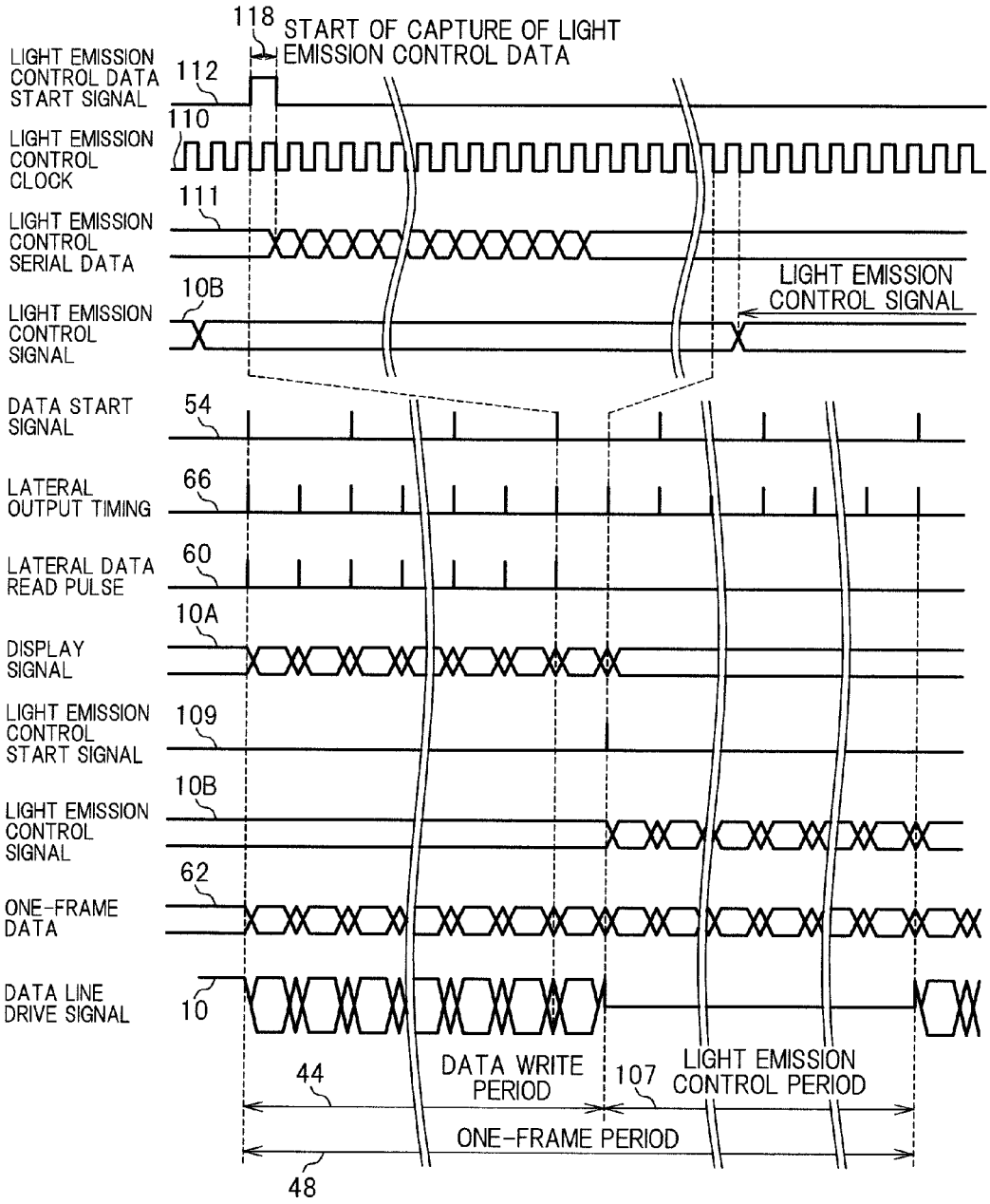
FIG. 7 is a timing chart illustrating an operation of the data line drive unit in the first embodiment of the present invention.

FIG. 7 is a timing chart illustrating an operation of the data line drive unit 9 in this embodiment. In FIG. 7, the light emission control serial data 111 (luminance gradient information 111) is captured at a light emission control clock 110 relative to a light emission control data capture start timing 118 in which a light emission control data start signal 112 becomes "1". All the light emission control serial data 111 are captured, and then each of the light emission control serial data 111 is output as the light emission control signal 10B in response to the light emission control start signal 109.

In this embodiment, the display region 17 has a resolution of 480 dots in a longitudinal direction (column direction) and 240 dots in a lateral direction (row direction). Each of the dots includes three pixels of red (R), green (G), and blue (B), which are arranged in order from the left. Thus, the organic EL panel has 720 pixels in the lateral direction. Note that, the resolution of the organic EL display device 200 is not limited to the resolution of 480×240 dots. Another resolution may be employed. In this case, for example, the number of data lines 18 is changed as appropriate depending on the resolution.

Figure 8:
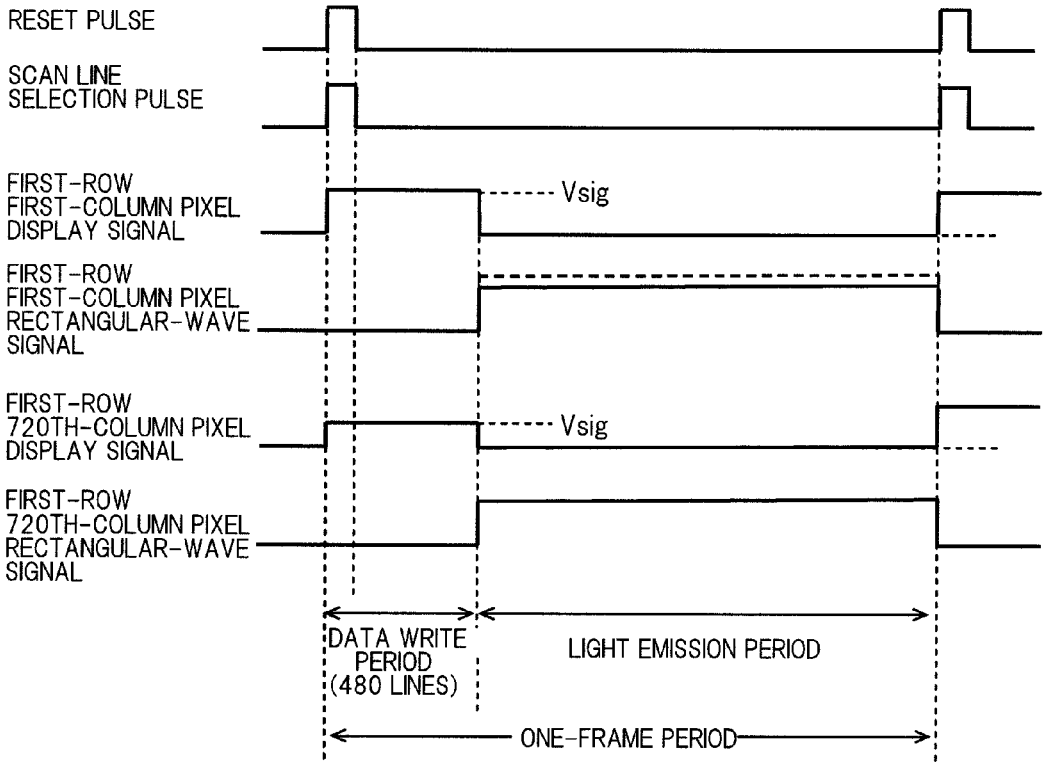
FIG. 8 illustrates an operation for correcting a luminance gradient based on a written display signal and a light emission control signal in the first embodiment of the present invention.

FIG. 8 illustrates an operation for correcting the luminance gradient based on the written display signal 10A and the light emission control signal 10B. First, in FIG. 8, a scan line selection pulse is output together with a reset pulse to select a first pixel row, and hence signals are supplied from the data lines 18 to the respective pixels of the first pixel row to write data into the pixels. In this embodiment, the write operation of data corresponding to 480 lines is performed during the data write period of the one-frame period (1/60 seconds). Then, the light emission period in which light are emitted from all the pixels of the display region 17 of the organic EL panel follows the data write period. As illustrated in FIG. 8, a voltage Vsig based on a gradation value, which is stored in the capacitor element 31B, is common between a first-row first-column pixel and a first-row 720th-column pixel, but a reference voltage represented by a rectangular-wave signal is changed therebetween. The rectangular-wave signal for first-column pixels located farther from the power supply unit 15 than 720th-column pixels is shifted to a level lower than the rectangular-wave signal for the first-row 720th-column pixel. Therefore, the supply of current to the first-column pixels of which luminances are reduced by voltage drop is facilitated to eliminate the luminance gradient.

Figure 9:
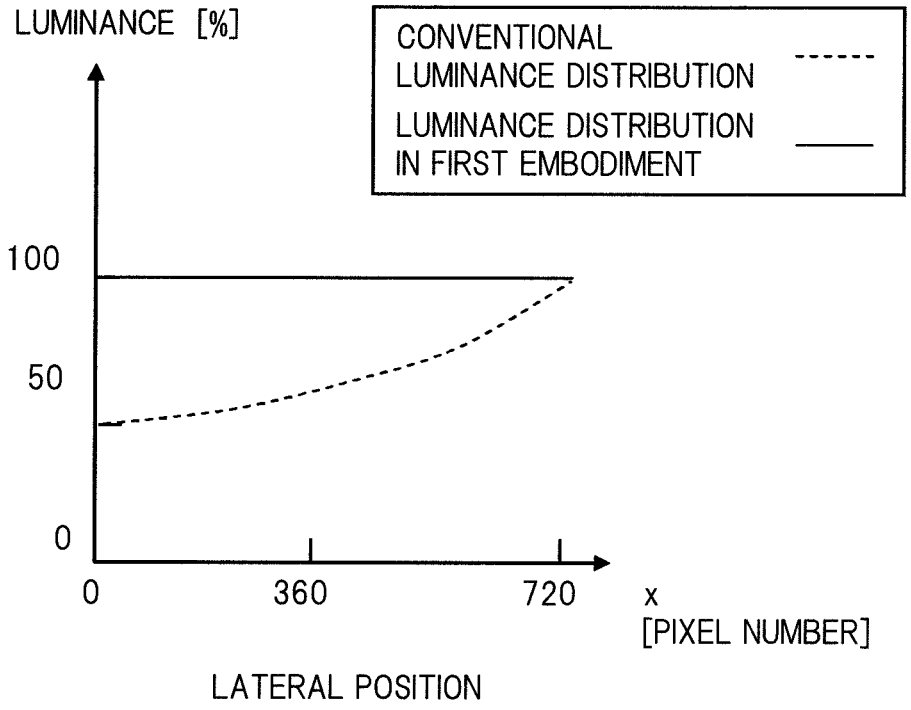
FIG. 9 is a schematic graph illustrating a lateral luminance distribution in the display device according to the first embodiment of the present invention, and a lateral luminance distribution in a conventional display device.
Figure 10:
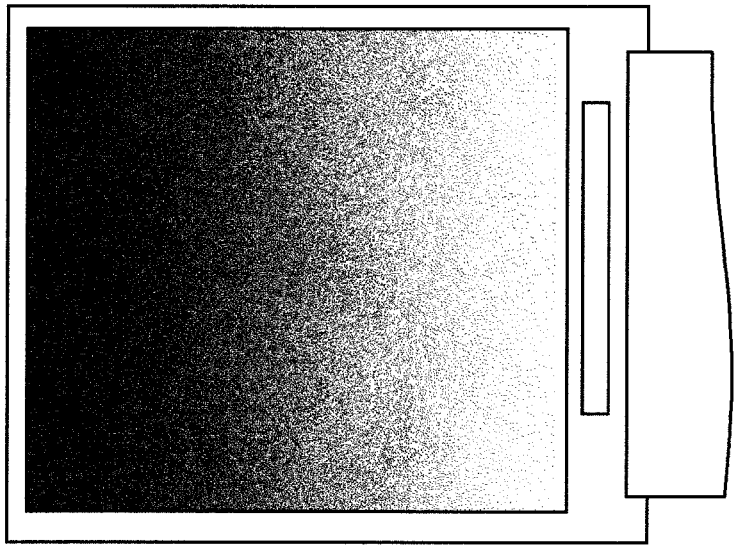
FIG.10 RELATED ART
FIG. 10 is an explanatory view illustrating a generation state of a luminance gradient in which luminance is gradually changed by drop of voltages from power supply unit in a display device according to a related art.
Figure 11:
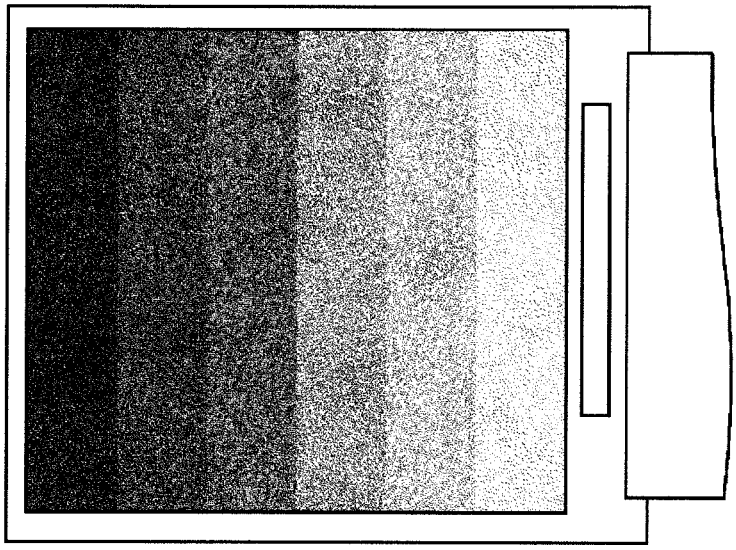
FIG.11 RELATED ART
FIG. 11 is an explanatory view illustrating a state of correction steps when the luminance gradient caused by the voltage drop is corrected in the display device according to the related art.

FIG. 9 is a schematic graph illustrating a lateral luminance distribution in the display device according to this embodiment and a lateral luminance distribution in a conventional display device. Each of the luminance distributions illustrated in FIG. 9 is a luminance distribution of 720 pixels located on a predetermined line in the lateral direction. The ordinate indicates a comparison value (%) with the target luminance value of each of the pixels displayed during the one-frame period 48. For example, when a target luminance value of a pixel of which a lateral position is 1 (first column) is 200, a luminance in the conventional luminance distribution is 100 which is 50% of the target luminance value because of the luminance gradient. The reference voltage is corrected to facilitate the supply of a current from the power supply line 24 to the light emitting element of the pixel connected to the data line 18 far away from the power supply unit 15, and hence the luminance of the pixel may be approached to the target luminance value.

In this embodiment, when the luminance gradient information 111 is generated, the luminance value in the central pixel row (240th row) of a displayed frame image is obtained. However, a luminance value of another pixel row may be obtained. Luminance values of a plurality of (or all) pixel rows may be averaged or integrated to generate one-line luminance information. A luminance value corresponding to a plurality of pixel columns may be used as the one-line luminance information. As described above, the voltage drop information is generated based on the one-line luminance data to derive the luminance gradient information 111. However, the total luminance of the displayed image substantially corresponds to the current from the power supply unit 15, and hence the voltage drop information may be generated based on the total luminance of the displayed image, or the like, to derive the luminance gradient information 111. In this case, the luminance gradient information generation unit 63 may obtain at least a part of the displayed image to determine total brightness, store a table in which the voltage drop information and the luminance gradient information 111 are associated with the total brightness in advance, and consult the table to output the luminance gradient information 111. The luminance gradient information generation unit 63 obtains the display input serial data 56 to generate the luminance gradient information 111. However, the light emission control unit 108 may receive information related to the displayed image from the frame storage unit 69, derive a luminance gradient caused in the displayed image, and set a correction voltage.

In this embodiment, the reference voltages are supplied to the plurality of data lines 18 arranged apart from the power supply unit 15. However, the reference voltages may be supplied to other signal lines. Further, in this embodiment, the light emitting element drive wiring 16 is provided as the relatively-high resistance wiring, each of the power supply lines 24 is provided as the relatively-low resistance wiring, and the reference voltage is shifted as the distance between each of the data lines 18 and the power supply unit 15 increases. However, other cases may be accepted as long as a shifted reference voltage is supplied to a pixel apart from the power supply unit 15.

In this embodiment, the circuit as illustrated in FIG. 2 is used. However, the present invention is not limited to such a circuit structure and may be applied to a display device capable of correcting a luminance gradient based on the reference voltage. The display device may use the organic EL element as described in this embodiment or use another element, for example, a light-emitting diode. When the organic EL element is used, a light emission material used for an organic EL layer may be a low-molecular material or a polymer material. A light extraction type may be a bottom emission type or a top emission type.

Second Embodiment

In the first embodiment described above, the display region 17 has the resolution of 480 dots in the longitudinal direction (column direction) and 240 dots in the lateral direction (row direction). Each of the dots includes three pixels of red (R), green (G), and blue (B), which are arranged in order from the left. The reference voltages applied to the three pixels of R, G, and B are determined based on the currents supplied from the power supply lines 24 and the positional relationship with the power supply unit 15. However, the characteristics including the light emission start voltage, of the organic EL elements 35 in the three pixels of R, G, and B are different from one another. Therefore, in a second embodiment, the light emission control unit 108 determines the reference voltage applied to each of the pixels of R, G, and B to control the current supplied to the organic EL elements 35 of the pixels of R, G, and B. The second embodiment is different from the first embodiment in this point. Therefore, in the second embodiment, the light emission control unit 108 determines the reference voltage for each of light emission colors of the organic EL elements 35 based on a variation in luminance which is caused depending on the positional relationship with the power supply unit 15, and the correction voltage setting unit 681 and the reference voltage determining unit 682 are provided for each of colors of R, G, and B. The luminance gradient information generation unit 63 may also be provided for each of colors of R, G, and B to generate the luminance gradient information 111 for each of colors of R, G, and B. Other points in the second embodiment are substantially the same as in the first embodiment and hence the description thereof is omitted. The reference voltage is controlled for each of colors of R, G, and B to correct the voltage drop, and hence a tint, for example, a blue tint, which is more likely to be caused in a dark area of an image, may be suppressed to correct the luminance gradient.

The display device according to each of the embodiments of the present invention is not limited to the respective embodiments described above. The first embodiment and the second embodiment may be combined with each other, and other embodiments within the scope of the technical idea of the present invention may be realized.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a display region in which a plurality of light emitting elements are arranged;

a power supply unit provided outside the display region;

a plurality of power supply lines connected to the power supply unit, for supplying power to the light emitting elements;

a plurality of signal lines for supplying, when the plurality of power supply lines input a current to emit light from the light emitting elements, reference voltages that control light emission luminances of the light emitting elements; and a light emission control unit for individually outputting the reference voltages to the respective signal lines to display an image on the display region, based on information associated with a one-frame image, wherein the light emission control unit comprises:

correction voltage setting unit for discretely setting a predetermined number of steps of correction voltages; and reference voltage determining unit for selecting one of a predetermined number of steps of correction voltages set by the correction voltage setting unit, based on the information associated with the one-frame image, to determine the reference voltages of the respective signal lines, and wherein the plurality of signal lines are respectively connected to pixels which are configured to have the same light emission color as one another, wherein the correction voltage setting unit is configured to set an upper limit value and a lower limit value of the correction voltages based on information associated with the one-frame image, and the reference voltage determining unit is configured to individually select, for each of the plurality of signal lines, one of the predetermined steps of correction voltages that are discretely set in a range of the upper limit value and the lower limit value of the correction voltages.

2. The display device according to claim 1, wherein the plurality of power supply lines are arranged at an increasing distances from the power supply unit, and connected to wirings which have a predetermined resistance value and extend from the power supply unit, to be connected to the power supply unit.

3. The display device according to claim 1, wherein the reference voltage determining unit is configured to shift one of the reference voltages which is applied to one of the plurality of pixels connected to the respective signal lines based on a luminance of the one of the plurality of pixels and a distance associated with the one of the plurality of pixels and the power supply unit.

4. The display device according to claim 1, wherein:

the plurality of signal lines are provided for a plurality of light emission colors of the light emitting elements, the light emission control unit comprises the correction voltage setting unit and the reference voltage determining unit for the plurality of light emission colors of the light emitting elements; and the reference voltage determining unit is configured to shift one of the reference voltages which is applied to one of the plurality of signal lines based on a luminance of one of the plurality of pixels which is connected to the one of the plurality of signal lines and a distance associated with the one of the plurality of signal lines and the power supply unit.

* * * * *